United States Patent [19]

Chariton et al.

[11] Patent Number: 5,009,361

[45] Date of Patent: Apr. 23, 1991

[54] PROTECTIVE COVER FOR A FILE FOLDER

[76] Inventors: Zhenia J. Chariton, 630 Arlington, Novato, Calif. 94947; Barbara J. Teixeira, 2618 Las Gallinas Ave., San Rafael, Calif. 94903

[21] Appl. No.: 451,989

[22] Filed: Dec. 18, 1989

[51] Int. Cl.[5] ..... B65D 27/00

[52] U.S. Cl. ..... 229/1.5 R; 281/19.1; 281/20

[58] Field of Search ..... 229/1.5 R; 281/19.1, 281/20, 34, 35

[56] References Cited

U.S. PATENT DOCUMENTS

| | | | |
|---|---|---|---|
| 1,354,354 | 9/1920 | Toland | 281/34 |
| 2,946,604 | 7/1960 | Hunger et al. | 281/34 |
| 3,099,464 | 7/1963 | Smith | 281/20 |
| 4,128,262 | 12/1978 | Du Corday | 281/34 |
| 4,209,187 | 6/1980 | Forrest | 281/19.1 |

FOREIGN PATENT DOCUMENTS

| | | | |
|---|---|---|---|
| 875141 | 9/1942 | France | 281/34 |

*Primary Examiner*—Stephen P. Garbe

[57] ABSTRACT

The protective cover of this invention includes a pair of cover panels separated by one or more score lines. The protective panels cover the panels of a file folder, and inner flaps along at least the top and bottom edges of the cover panel receive the corresponding edges of the file folder panels. A pocket depending from the bottom edge of at least one of the cover panels receives and interlocks with the label tab on the bottom edge of the file folder.

10 Claims, 1 Drawing Sheet

PROTECTIVE COVER FOR A FILE FOLDER

BACKGROUND OF THE INVENTION

File folders in many offices, such as a patient's file folder in a doctor's office are frequently removed for reference to the information therein and for updating the same, and then replaced. Such file folders are, therefore, subject to considerable wear and tear.

OBJECTS OF THE INVENTION

It is an object of this invention to provide a protective cover for a file folder to protect it against becoming dog earred and torn.

It is a further object of this invention to provide a protective cover for a file folder that will interlock with the file folder to prevent inadvertent removal therefrom.

It is a further object of this invention to provide a protective cover for a file folder, which is simple and economical to manufacture.

Other objects and advantages of this invention will become apparent from the description to follow, particularly when read in conjunction with the accompanying drawing.

SUMMARY OF THE INVENTION

In carrying out this invention, we provide a protective cover, preferably of transparent plastic, having a pair of panels separated by two or more fold lines to cover the corresponding panels of the file folder. Flaps along the top and bottom edges of both panels, as well as along the side edge of at least one panel, receive the corresponding edges of the file folder, and a pocket depending from the bottom edge of one panel receives and interlocks with the label tab, which customarily extends from one edge of the file folder. This not only protects the label tab, but interlocks with it to prevent inadvertent removal of the file folder from the protective cover.

DESCRIPTION OF A PREFERRED EMBODIMENT

Figure 1:
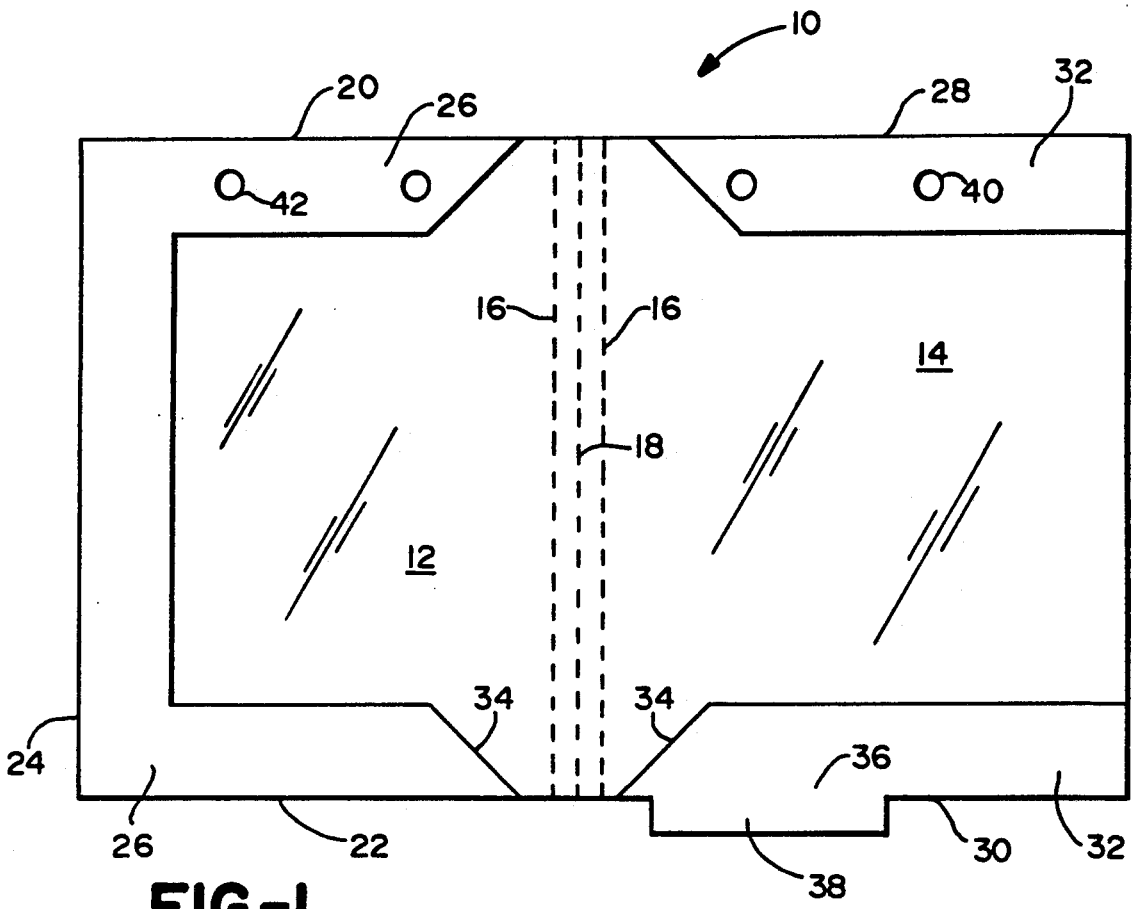
FIG. 1 is the top plan view of the inside of an opened protective cover of this invention.
Figure 2:
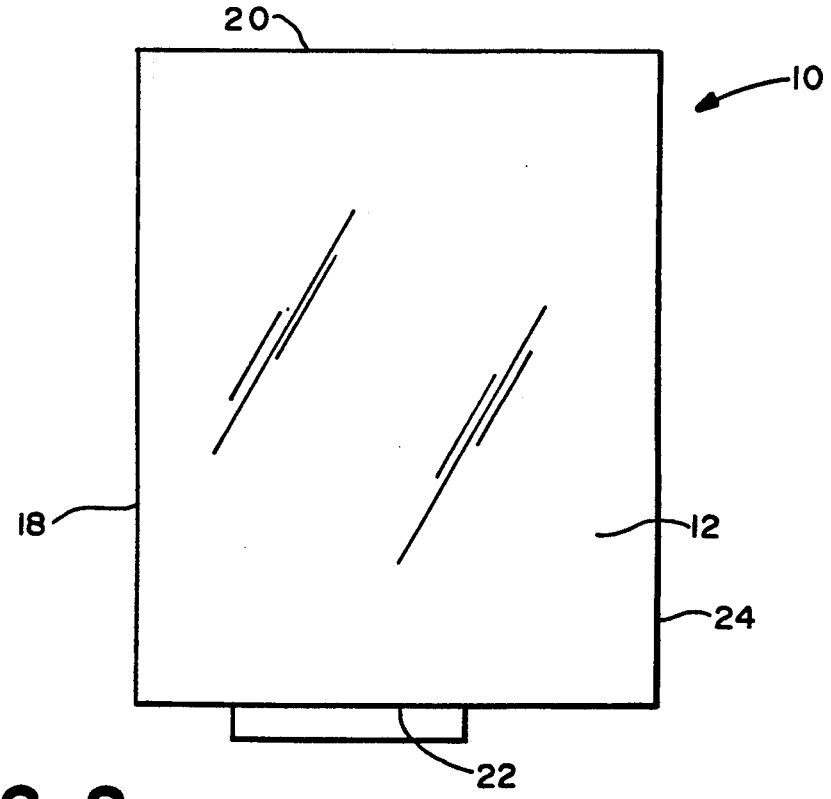
FIG. 2 is a top plan view of the outside of a folded protective cover.

Referring now to the drawing with greater particularity, the protective cover 10 of this invention has left and right panels 12 and 14, each of which corresponds in size and shape to the panel of a file folder for shelf or lateral filing. Intermediate the panels 12 and 14 are several score lines 16, which enable the protective cover to be folded other than the center fold line 18 in order to accomodate a file folder that has expanded with the accumulation of documents.

Along the top and bottom edges 20 and 22 and the side edge 24 of the left panel 12 are flaps 26 to receive and accomodate the edges of the corresponding panel of the file folder (not shown). Similarly, the top and bottom edges 28 and 30 of the right side panel have integral flaps 32 to accomodate the edges of the corresponding right-hand panel of the file folder. It is to be understood that a flap could also be provided at the side edge of the right panel 14, but to facilitate insertion of the file folder either from the right or from the center, that flap may be omitted.

The top and bottom flaps 26 and 32 on both right-hand and left-hand panels are preferably cut off at 34, short of the score lines 16, in order to facilitate insertion of a file folder from the center.

As a particular feature of this invention, we provide means for receiving and interlocking the edges of the file folder and the protective cover 10, specifically, the bottom flap 32 is provided with a slot 36 at the bottom, which is surrounded by an integral pocket 38 to receive and protect the side edge label tab customarily found on the side edge of a shelf or lateral folder.

Hence, the label tab of the file folder will interlock with the protective cover 12 by insertion of the label tab into pocket 38 thereby to prevent inadvertent removal of the protective cover 10 during handling.

In addition to the above, at least the upper flap 32 on the right-hand panel 14 is provided with holes 40 to receive the bendable clasps customarily attached to the upper edge of the file folder and preferably such holes 42 are also provided on the opposite flap 26. If desired, either or both pairs of holes 40 and 42 be of the "punch out" variety. Hence, the file folder itself will be covered by the plastic panel but any papers filed therein (not shown) are readily excessable for full view, as well as for removal and replacement, as desired.

While this invention has been described in conjunction with a preferred embodiment thereof, it is obvious that modifications and changes therein may be made by those skilled in the art to which it pertains without departing from the spirit and scope of this invention, as defined by claims appended hereto.

What is claimed as invention is:

1. A protective cover for a file folder having left and right panels separated by at least one fold line, each said panel having top and bottom edges and a side edge and one of said panels having a label tab depending from the bottom edge thereof; said protective cover comprising:

a pair of cover panels, each of a size and shape to cover completely one of said file folder right and left panels, said cover panels being separated by at least one score line;

top and bottom flaps on said cover panels to receive said top and bottom edges of said left and right panels;

means forming a slot in the bottom flap of one of said cover panels to receive and interlock with said label tab.

2. The protective cover for a file folder defined by claim 1 including;

a side flap on at least one of said cover panels to receive the side edge of one of said left and right panels.

3. The protective cover defined by claim 1 including;

means forming a pair of holes in the top panel of one of said cover panels to receive clasps on one of said right and left panels.

4. The protective cover defined by claim 1 including:

a pocket depending from the bottom flap of one of said cover panels around said slot to receive said label tab.

5. The protective cover for a file folder defined by claim 1 wherein:

there are at least two parallel score lines between said cover panels to accommodate expansion of said file folder.

6. A protective cover for a file folder having left and right panels separated by at least one fold line, each said panel having top and bottom edges and a side edge and one of said panels having a label tab depending from the bottom edge thereof; said protective cover comprising:

a pair of integral cover panels joined by a hinge between them each of a size and shape to cover completely one of said right and left file folder panels;

top and bottom flaps on said cover panels to receive said top and bottom edges on said left and right file folder panels; and a pocket depending from the bottom flap of one of said cover panels to receive said label tab.

7. The protective cover for a file folder defined by claim 6 including;

a side flap on at least one of said cover panels to receive the side edge of one of said left and right panels.

8. The protective cover defined by claim 6 including;

means forming a pair of holes in the top of one of said cover panels to receive clasps on one of said right and left panels.

9. The protective cover defined by claim 6 wherein:

The flaps on each said cover panel are integral therewith.

10. The protective cover for a file folder defined by claim 6 wherein:

said hinge is wide enough to accomodate expansion of said file folder.

* * * * *